United States Patent [19]

Tomasetti et al.

[11] 4,160,185

[45] Jul. 3, 1979

[54] RED SENSITIVE PHOTOCATHODE HAVING AN ALUMINUM OXIDE BARRIER LAYER

[75] Inventors: Charles M. Tomasetti, Leola; Arthur F. McDonie, Lancaster, both of Pa.

[73] Assignee: RCA Corporation, New York, N.Y.

[21] Appl. No.: 860,562

[22] Filed: Dec. 14, 1977

[51] Int. Cl.[2] ..... H01J 39/06; B05D 5/12

[52] U.S. Cl. ..... 313/94; 427/42; 427/77; 427/78; 427/377; 427/343; 204/192 C

[58] Field of Search ..... 427/77, 78, 38, 42, 427/377, 343, 399; 313/346 R, 94; 316/6, 8, 12, 4; 204/192 C

[56] References Cited

U.S. PATENT DOCUMENTS

| | | | |
|---|---|---|---|
| 3,739,216 | 6/1973 | Pakswer | 427/78 |
| 3,753,023 | 8/1973 | Sommer | 427/78 |
| 3,901,784 | 8/1975 | Quinn | 204/192 C |
| 3,912,829 | 10/1975 | Takahashi | 427/78 |
| 4,002,735 | 1/1977 | McDonie et al. | 427/78 |
| 4,009,409 | 2/1977 | Buercher | 427/77 |
| 4,039,887 | 8/1977 | McDonie | 313/346 R |

*Primary Examiner*—Michael F. Esposito
*Attorney, Agent, or Firm*—E. M. Whitacre; G. H. Bruestle; R. M. Rodrick

[57] ABSTRACT

In a photomultiplier tube, antimony layers of a photocathode are prepared on a nickel substrate by providing a barrier layer of aluminum oxide between the substrate and antimony layers. The photocathode is subsequently exposed to the vapors of at least one alkali metal to sensitize the antimony layers. The aluminum oxide layer prevents alloying of the nickel with the antimony at processing temperatures in the range from 260° C. to 285° C. and provides a source of oxygen to oxidize the photocathode for increased photosensitivity, the oxidation time being a function of the thickness of the aluminum oxide layer. The photocathode is then exposed to cesium and may be superficially oxidized until substantially maximum photosensitivity is achieved.

7 Claims, 1 Drawing Figure

RED SENSITIVE PHOTOCATHODE HAVING AN ALUMINUM OXIDE BARRIER LAYER

BACKGROUND OF THE INVENTION

1. Field of the Invention

This invention relates to the art of making electron emission surfaces sensitized by exposure to alkali metals and more particularly to the preparation of such surfaces for increased red photosensitivity.

2. Description of the Prior Art

Methods of sensitizing electron emissive surfaces of, for example, supported base layers of antimony are well known in the art of electron discharge devices. Photoemissive materials and techniques relating thereto are, for example, described in *Photoemissive Materials* by A. H. Sommer, John Wiley and Sons, Inc., New York, 1968 and is herein incorporated by reference.

In the manufacture of photomultipliers, it is desirable to have a photocathode which is highly sensitive to visible and near infrared light and which provides a high signal to noise ratio. In general, two procedures have been utilized which lead to electron emissive electrodes of increased photosensitivity. The first is the process of superficial oxidation and the second is the use of a relatively thin manganese oxide, both of which are disclosed in *Photoemissive Materials* and in U.S. Pat. No. 4,002,735 issued to McDonie et al on Jan. 11, 1977.

In a photocathode, for example, comprising an evaporated film of antimony sensitized by exposure to cesium, a significant increase in cathode sensitivity has been measured after introduction of controlled quantities of oxygen. The introduction of the oxygen primarily reduces the surface barrier of the cathode, resulting in increased response to all wavelengths, longer threshold wavelength and a lower photoelectric work function. However, it has been determined that there is a level at which further exposure to oxygen reduces the cathode sensitivity.

It has also been found that the chemical nature of the electrode may affect the photoemissive properties of a photocathode. In phototubes, a cesium-antimony cathode, for example, is often deposited on a solid metal substrate, usually made of a metal suitable for use in vacuum tubes, such as nickel. Frequently the antimony film is evaporated onto the substrate before the substrate is mounted in the tube and hence before degassing. It has been observed that at degassing temperature above 265° C. significant alloying of nickel occurs with the antimony. An efficient photocathode cannot be produced with the antimony-alloy electrode since there is insufficient antimony available for a reaction. Various techniques have been adopted to avoid or minimize the alloy formations, permitting higher temperatures for degassing. Bake out temperatures, however, must remain below 285° C. with antimony electrodes, since the antimony will evaporate above this temperature in a vacuum.

One method of preventing alloying is the adjustment of the antimony thickness in such a way that the substrate metal is not diffused into the pure antimony within the escape depth of photoelectrons. Another technique of alloy prevention is the deposition of an intermediate layer between the nickel substrate and the antimony layer. The material of such an intermediate layer widely used is manganese oxide, such as referred to previously in U.S. Pat. No. 4,002,735. Manganese oxide is often utilized in photocathodes since not only does it prevent alloy formation but also tends to produce cathodes with higher quantum yield and a longer threshold wavelength, qualitatively similar to the effects produced by superficial oxidation, in particular in semitransparent cesium-antimony cathodes. Although the manganese oxide appears to have a specific effect on the photoemissive properties of the cathode, this effect has not been found to be directly attributable to the amount of oxygen available. It has been experimentally concluded that the oxidation time of the cathode is independent of the thickness of the manganese oxide. (See *Photoemissive Materials*, page 74)

Establishment of definite relationships of the chemical nature of photoemissive surfaces, such as that between oxidation time and the thickness of an intermediate film, is desirable and advantageous since the effects on photoemissive properties may be more readily determined by these relationships. Such relationships could be utilized to achieve photocathodes of improved sensitivity since the factors which affect the photoemissive properties could be more effectively controlled.

SUMMARY OF THE INVENTION

A method is provided for making an electron emissive electrode including a supporting substrate of nickel and a base layer of antimony. The electrode, preferably a photocathode, is baked at a temperature from 260° C. to 285° C. at a pressure of less than $10^{-4}$ torr. The base layer is sensitized by exposing a surface portion of the layer to the vapors of at least one alkali metal at a temperature lower than the bake out temperature and at a pressure less than $10^{-4}$ torr. Formed between the nickel substrate and the antimony layer is an oxide film. The oxide film prevents alloying of the nickel substrate with the antimony layer during bake out and provides oxygen to oxidize the photocathode from the substrate side to increase the red photosensitivity, the oxidation time being a function of the thickness of the oxide film.

BRIEF DESCRIPTION OF THE DRAWING

The sole FIGURE of the drawing is a non-scale cross-sectional view of a photocathode formed according to the present invention.

DETAILED DESCRIPTION OF THE PREFERRED EMBODIMENT

Figure 1:
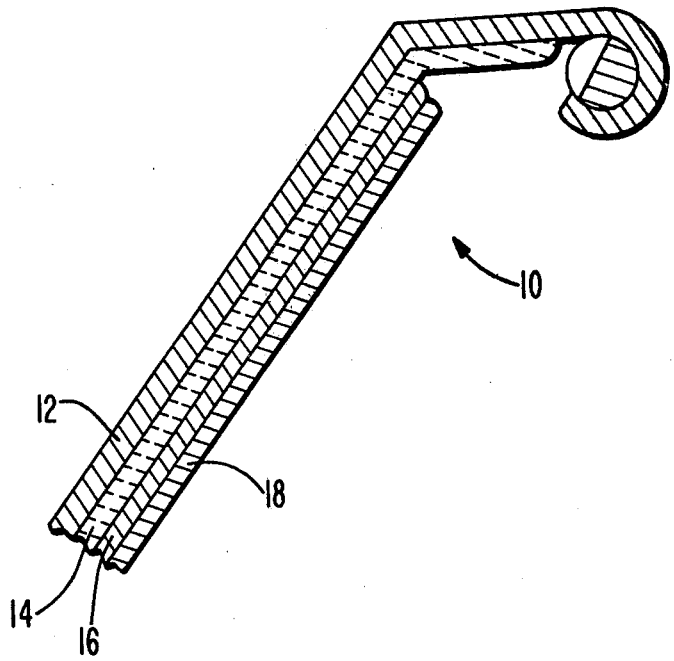

The preferred embodiment is a method of preparing a photocathode wherein aluminum oxide ($Al_2O_3$) is utilized as a substrate coating to prevent undesirable alloying of photocathode components and to advantageously influence the photoemissive properties of the photocathode. Typical prior art photocathodes comprise a substrate of nickel onto which a layer of antimony is evaporated. In one case, the nickel substrate is oxidized and no barrier is formed between the nickel and the antimony. In another case, the nickel is not oxidized and a layer of manganese oxide ($Mn_xO_y$ where $x=2$, $y=3$ or $x=3$, $y=4$), e.g. 1000A thick is formed as a barrier layer between the nickel substrate and the antimony. In the novel device, the aluminum oxide is utilized in either case, i.e., as a barrier between oxidized or nonoxidized nickel and the antimony layer. Such a photocathode may be utilized in photomultiplier tubes or other vacuum type devices including sensitized electron emissive electrodes.

There is shown in the drawing in exaggerated detail, a photocathode 10. The photocathode 10 comprises in overlay sequence: a supporting nickel substrate 12, preferably oxidized or bright nickel, a thin film of aluminum oxide 14 along a major surface of the substrate 12, and evaporated solid and porous antimony (Sb) layers 16 and 18, respectively, overlying the aluminum oxide film.

One method of preparing the aluminum oxide layer 14 of the photocathode 10 is by electron beam deposition. In this process the nickel substrate 12 is placed in a vacuum chamber (not shown) and heated to approximately 250° C. The vacuum chamber is first pumped down to a vacuum of about $10^{-6}$ torr and thereafter raised by the introduction of oxygen to a vacuum of about $10^{-4}$ torr. The substrate 12 is coated by electron beam deposition in the chamber by use of a 3 kilovolt electron beam, for example, bombarding a target of powdered aluminum oxide placed at the electron beam anode (not shown). Only the active side of the photocathode supporting nickel substrate 12 is coated with aluminum oxide. For this process the substrate 12 is placed about 12–18 inches (30.48–45.72 cm.) away from the aluminum oxide source. The thickness of aluminum oxide deposited on substrate 12 is monitored by means of a calibrated quartz crystal sensor located within the deposition chamber. A deposition thickness of aluminum oxide in the range from 800 to 1600 Angstroms is preferred, as will be described. Another technique of coating the substrate 12 with aluminum oxide includes ion beam sputtering of the aluminum oxide onto the substrate 12 in an oxygen or argon atmosphere.

The solid and porous antimony layers 16 and 18, respectively, are formed on the aluminum oxide layer 14 by an evaporation process well known in the art.

As a preliminary step to activation of the photocathode 10 to ultimately achieve the desired electron emissivity, a photomultiplier tube, including photocathode 10, is generally baked out in an oven. During the bake out the tube is evacuated and heated for a period of one to three hours at a temperature from about 260° C. to less than 285° C. to degas the tube components and to eliminate contaminants from the interior of the tube. It is critical that the bake-out temperature be less than 285° C. since above that temperature antimony will evaporate in a vacuum and trace impurities may also diffuse from the nickel substrate 12. Higher temperatures may be utilized if the system is backfilled with a neutral gas such as argon.

During the entire processing, the interior of the tube is continually evacuated through an exhaust system (not shown) which is capable of establishing initial pressure levels of less than about $10^{-4}$ torr (preferably, pressure levels less than about $10^{-5}$ torr) within the tube interior.

After the tube is baked out, the activation of exposed surface portions of the photocathode 10 which are to be sensitized by exposure to the vapors of at least one alkali metal may proceed in a manner as described in U.S. Pat. No. 4,002,735 to McDonie et al, issued Jan. 11, 1977 and herein incorporated by reference. In brief, antimony layers of a photocathode in a photomultiplier tube including a plurality of dynodes are sensitized by exposure to the vapors of sodium and potassium at an initial temperature of less than about 120° C. The temperature of exposure is gradually increased at a rate of less than about 10° C. per minute until a final temperature of about 200° C. is reached. Then the photocathode is baked at the final temperature until substantially maximum photosensitivity is achieved. The photocathode is thereafter exposed to cesium and may be superficially oxidized until substantially maximum photosensitivity is achieved. During the sensitizing process the pressure level is maintained at a level less than $10^{-4}$ torr.

In practice, the superficial oxidation is performed by introducing minute quantities of oxygen into the tube while the photosensitivity is monitored and pumping out the oxygen at once when the peak sensitivity is reached. This process is only partially reversible by baking, i.e., excess oxidation reduces the sensitivity permanently. Therefore, the oxygen must be introduced through a finely controlled valve or by careful heating of a material, such as potassium chlorate, mercury oxide or barium oxide that releases pure oxygen when it decomposes.

A photomultiplier tube utilizing a photocathode prepared by the hereindescribed process has resulted in a 20% increase in average luminous sensitivity and better than a 25% increase in near infrared sensitivity in the red side of the spectral response over prior art photocathodes using manganese oxide as a barrier layer. In addition to preventing alloying between the nickel substrate 12 and the antimony layers 16 and 18 at temperatures above 265° C. as does manganese oxide, the aluminum oxide layer 14 apparently has a specific effect on the photoemissive properties of the cathode which manganese oxide does not have. The aluminum oxide layer 14 introduces oxygen to oxidize the photocathode in a manner which seems to be well controlled. It has been determined that the use of aluminum oxide not only affects the oxidation time of the photocathode, but that there is a definite influence of the thickness of aluminum oxide on oxidation time. More specifically, the oxidation time has been found to increase with an increase in the thickness of aluminum oxide. However, as with superficial oxidation, there is a level at which excess availability of oxygen has a detrimental effect on photosensitivity. It has been empirically determined that the optimum thickness of aluminum oxide lies in the range from 800 to 1600 Angstroms. The process does not appear, however, to be critically dependent upon the aluminum oxide thickness within this range. Although it has been determined that the optimum aluminum oxide thickness be in the range from 800 to 1600 Angstroms, significant improvements over the prior art have also been measured in photocathodes having an aluminum oxide thickness in the range from 400 to 2500 Angstroms.

The process as herein described results in a photocathode of improved sensitivity over the prior art for electron emission surfaces produced with and without the additional step of superficial oxidation. Without superficial oxidation the aluminum oxide appears to introduce the oxygen as detailed above in a well controlled manner, with the oxidation time being regulated by the aluminum oxide thickness. With superficial oxidation the introduction of additional oxygen further enhances the sensitivity of the photocathode subject to the excessive limitations as previously outlined. Such a definite relationship between the oxidation time and the thickness of the aluminum oxide layer have not only resulted in photocathodes of increased sensitivity but will also result in improved repeatability and reductions in cost.

What is claimed is:

1. In a method of making an electron emissive electrode including a supporting substrate of nickel and a base layer of antimony, comprising the steps of:

(a) baking said electrode at a temperature from 260° C. to 285° C. at a pressure of less than $10^{-4}$ torr; then (b) sensitizing said base layer by exposing a surface portion thereof to the vapors of at least one alkali metal at a temperature lower than said bake temperature at a pressure of less than $10^{-4}$ torr; wherein the improvement comprises the step of:

forming between said nickel substrate and said antimony layer an aluminum oxide film for preventing the alloying of said nickel substrate with said antimony layer during bake and for providing oxygen to oxidize said electrode and increase the red photosensitivity of said electrode.

2. A method according to claim 1, further comprising the step of superficially oxidizing the sensitized electron emissive surface portion resulting from step (b) until substantially maximum photosensitivity is achieved.

3. A method according to claim 1, wherein the film of aluminum oxide has a thickness in the range from 400 A to 2500 A.

4. A method according to claim 1, wherein said film of aluminum oxide is formed by heating said nickel substrate and exposing said heated substrate to aluminum oxide bombarded by an electron beam in an oxygen atmosphere.

5. A method according to claim 1, wherein said film of aluminum oxide is formed by ion beam sputtering aluminum oxide onto said substrate in an oxygen or argon atmosphere.

6. An electron emissive electrode comprising:

a supporting substrate of nickel;

a base layer of antimony on said substrate, said base layer being sensitized with the vapors of at least one alkali metal; and an aluminum oxide film between said nickel substrate and said antimony layer for preventing alloying of said nickel substrate with said antimony layer at processing temperatures in the range from 260° C. to 285° C. and for providing oxygen to oxidize said electrode and increase the red photosensitivity of said electrode.

7. An electrode according to claim 7, wherein said film of aluminum oxide has a thickness in the range from 400 A to 2500 A.

* * * * *